US006002366A

United States Patent [19]

Kawahata et al.

[11] Patent Number: 6,002,366

[45] **Date of Patent: *Dec. 14, 1999**

[54] SURFACE MOUNT ANTENNA AND COMMUNICATION APPARATUS USING SAME

[75] Inventors: Kazunari Kawahata, Kyoto; Kazuhisa Yamaki, Muko, both of Japan

[73] Assignee: Murata Manufacturing Co. Ltd, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/727,703

[22] Filed: Oct. 4, 1996

[30] Foreign Application Priority Data

Oct. 6, 1995 [JP] Japan ..... 7-260231

[51] Int. Cl.[6] ..... H01Q 1/38

[52] U.S. Cl. ..... 343/700 MS; 343/702; 343/829; 343/873

[58] Field of Search ..... 343/700 MS, 702, 343/829, 846, 872, 873; H01Q 1/38

[56] References Cited

U.S. PATENT DOCUMENTS

| | | | |
|---|---|---|---|
| 5,581,262 | 12/1996 | Kawahata et al. | 343/700 |
| 5,585,810 | 12/1996 | Tsuru et al. | 343/700 |
| 5,684,492 | 11/1997 | Kagoshima et al. | 343/700 |

*Primary Examiner*—Don Wong
*Assistant Examiner*—Tho Phan
*Attorney, Agent, or Firm*—Ostrolenk, Faber, Gerb & Soffen, LLP

[57] ABSTRACT

A rectangular-prism-shaped base member is made from a dielectric material or a magnetic material. A ground electrode and a power supplying electrode are formed on one end face of the base member with a gap disposed therebetween. At least one through hole is formed between the end face and the opposing end face. A radiation electrode is formed on the inside surface of the through hole. One end of the radiation electrode is connected to the ground electrode, and the other end serves as an open end. The power supplying electrode and the radiation electrode are electromagnetically coupled through a capacitor formed at the gap.

41 Claims, 5 Drawing Sheets

SURFACE MOUNT ANTENNA AND COMMUNICATION APPARATUS USING SAME

BACKGROUND OF THE INVENTION

1. Field of the Invention

The present invention relates to a surface-mount antenna and communication apparatus using the same which are used in a radio local area network (LAN) and mobile communication equipment such as a portable telephone.

2. Description of the Related Art

FIG. 8 shows a conventional λ/4 surface-mount antenna. Through holes 22 and 23 are provided between one pair of end faces 21*a* and 21*b* in a base member 21. A first radiation electrode 24 and a second radiation electrode 25 are formed at the inside surfaces of the through holes 22 and 23, respectively. One end of the first radiation electrode 24 is connected to one end of a pattern electrode 26 formed on one end face 21*a*, and the other end of the first radiation electrode 24 serves as an open end 24*a* on the other end face 21*b*. One end of the second radiation electrode 25 is connected to the other end of the pattern electrode 26, and the other end of the second radiation electrode 25 is connected to a ground terminal 27 formed on an end face 21*b* in the base member 21.

There is also shown a power-supplying terminal pin 28. A metal pin 28*b* electrically connected to a power supplying terminal 28*a* is covered with resin 28*c*. The power supplying terminal pin 28 is inserted into the through hole 22 having the first radiation electrode 24 to form a capacitor between the metal pin 28*b* and the first radiation electrode 24 with the resin 28*c* serving as a dielectric. With this capacitor, a high-frequency signal is electromagnetically coupled with the first radiation electrode 24 to cause the high-frequency current to flow to the ground through the first radiation electrode 24, the pattern electrode 26, and the second radiation electrode 25. With this configuration, a radio wave is emitted.

In the conventional surface-mount antenna, the coupling level between the power supplying terminal pin 28 and the first radiation electrode 24 depends on how the power supplying terminal pin 28 is inserted into the first radiation electrode 24. The manner in which the terminal pin 28 is inserted may cause a frequency change. Therefore aging or dropping of the antenna causes a large frequency shift. Furthermore, since the power supplying terminal pin 28 is required, the antenna becomes large and is prevented from being made compact.

Electromagnetic coupling between the power supplying terminal pin 28 and the first radiation electrode 24 needs to be weak. Since the coupling is made at a high voltage, the level of coupling is difficult to adjust.

A communication apparatus using such a conventional surface-mount antenna also has the same drawbacks as a surface-mount antenna.

SUMMARY OF THE INVENTION

Accordingly, it is an object of the present invention to provide a surface-mount antenna which features a reduced frequency shift due to aging or dropping of the antenna, a low null point, a compact size, and easier coupling by supplying power in the vicinity of a ground electrode, and a communication apparatus using the same.

The foregoing and other objects are achieved in one aspect of the present invention through the provision of a surface-mount antenna comprising: a base member; a ground electrode and a power supplying electrode formed on one end face of the base member with a gap disposed therebetween; at least one through hole formed between the one end face and the opposite end face; and a radiation electrode formed on the inside surface of the through hole, wherein one end of the radiation electrode is connected to the ground electrode and the other end serves as an open end, and the power supplying electrode and the radiation electrode are electromagnetically coupled through a capacitor formed at the gap.

The foregoing and other objects are achieved in another aspect of the present invention through the provision of a surface-mount antenna comprising: a base member; a ground electrode and a part of a power supplying electrode formed on one end face of the base member; the rest of the power supplying electrode formed such that it extends to an adjacent end face; at least one through hole formed between the one end face and the opposite end face; and a radiation electrode formed on the inside surface of the through hole, wherein one end of the radiation electrode is connected to the ground electrode and the other end serves as an open end, and the power supplying electrode and the radiation electrode are electromagnetically coupled mainly through a capacitor formed by a base-member gap between the radiation electrode and the rest of the power supplying electrode formed on the adjacent end face.

The foregoing and other objects are achieved in still another aspect of the present invention through the provision of a surface-mount antenna comprising: a base member; at least one through hole formed in the base member; a radiation electrode formed on the inside surface of the through hole; a ground electrode and a part of a power supplying electrode formed on one end face of the base member; and the rest of the power supplying electrode formed such that it extends to a main surface adjacent to the one end face and close to the vicinity of the radiation electrode; wherein one end of the radiation electrode is connected to the ground electrode and the other end serves as an open end, and the power supplying electrode and the radiation electrode are electromagnetically coupled mainly through a capacitor formed by a base-member gap between the radiation electrode and the rest of the power supplying electrode formed on the main surface.

The foregoing and other objects are achieved in yet another aspect of the present invention through the provision of a surface-mount antenna comprising: a base member; a ground electrode and a power supplying electrode formed on one end face of the base member with a gap disposed therebetween; a pattern electrode formed on the end face opposite the one end face; a plurality of through holes formed between the one end face and the opposite end face; and radiation electrodes formed on the inside surfaces of the plurality of through holes, wherein one end of each of the radiation electrodes is connected to the ground electrode and the other end of each of the radiation electrodes is connected to the pattern electrode, and the power supplying electrode and the radiation electrode are electromagnetically coupled through a capacitor formed at the gap.

The foregoing and other objects are achieved in yet a further aspect of the present invention through the provision of a surface-mount antenna comprising: a base member; a ground electrode and a part of a power supplying electrode formed on one end face of the base member; the rest of the power supplying electrode formed such that it extends to an end face adjacent to the one end face; a pattern electrode formed on the end face opposite the one end face; a plurality of through holes formed between the one end face and the opposite end face; and radiation electrodes formed on the inside surfaces of the plurality of through holes, wherein one end of each of the radiation electrodes is connected to the ground electrode and the other end of each of the radiation electrodes is connected to the pattern electrode, and the power supplying electrode and the radiation electrode are electromagnetically coupled mainly through a capacitor formed by a base-member gap between the radiation electrode and the rest of the power supplying electrode formed on the adjacent end face.

The foregoing and other objects are achieved in a yet further aspect of the present invention through the provision of a surface-mount antenna comprising: a base member; a plurality of through holes formed in the base member; radiation electrodes formed on the inside surfaces of the plurality of through holes; a ground electrode and a part of a power supplying electrode formed on one end face of the base member; the rest of the power supplying electrode formed such that it extends to a main surface adjacent to the one end face and close to the vicinity of the radiation electrodes; and a pattern electrode formed on the end face opposite the one end face, wherein one end of each of the radiation electrodes is connected to the ground electrode and the other end of each of the radiation electrodes is connected to the pattern electrode, and the power supplying electrode and the radiation electrode are electromagnetically coupled mainly through a capacitor formed by a base-member gap between the radiation electrode and the rest of the power supplying electrode formed on the main surface.

According to the present invention, since electromagnetic coupling is made through a gap capacitor or a base-member-gap capacitor in the vicinity of the ground electrode for the radiation electrode, without using a coupling terminal pin, unlike a conventional surface-mount antenna, the frequency is not shifted due to aging or dropping of the antenna, and the surface-mount antenna can be made compact.

The foregoing and other objects are achieved in a still further aspect of the present invention through the provision of a communication apparatus wherein one of the above-described surface-mount antennas is mounted.

The communication apparatus having one of the above-described surface-mount antennas realizes the following features of such antenna: a small frequency shift, compactness, and a low null point in a radiation pattern.

As described above, in the surface-mount antennas each having one through hole and in the surface-mount antennas each having a plurality of through holes, the power supplying electrode and the radiation electrode are electromagnetically coupled in the vicinity of the ground electrode. In the surface-mount antennas each having a gap between the ground electrode and the power supplying electrode formed on an end face of the base member, electromagnetic coupling is made through a capacitor formed at the gap. In the surface-mount antennas each having a base-member gap between the radiation electrode and the part which is formed on the adjacent end face of the power supplying electrode which is formed such that it extends over two end faces of the base member, the power supplying electrode and the radiation electrode are electromagnetically coupled mainly through a capacitor formed at the base-member gap. In the surface-mount antennas each having a base-member gap between the radiation electrode and the power supplying electrode formed such that it extends over an end face and a main surface of the base member, the power supplying electrode and the radiation electrode is electromagnetically coupled mainly through a capacitor formed at the base-member gap.

In the surface-mount antennas each having a plurality of through holes, since a high-frequency current flows in a gate-shaped route, the radiation pattern has no null point, unlike the surface-mount antennas having one through hole. If the same chip size is used, the frequency can be reduced, and if the same frequency is used, the chip size can be reduced.

Other features and advantages of the present invention will become apparent from the following description of the invention which refers to the accompanying drawings.

DETAILED DESCRIPTION OF EMBODIMENTS OF THE INVENTION

Figure 1:
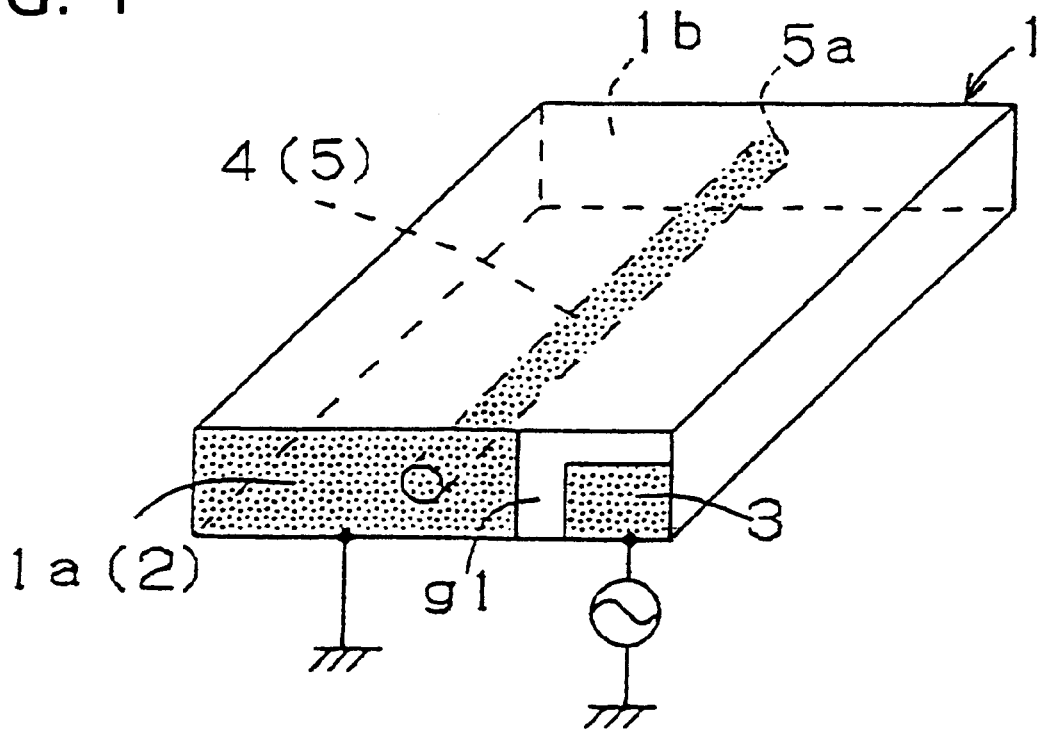
FIG. 1 is a perspective view of a surface-mount antenna according to a first embodiment of the present invention.

Embodiments of the present invention will be described below by referring to the drawings. FIG. 1 shows a first embodiment of the present invention. There is shown a rectangular-prism-shaped base member 1 made from a dielectric material such as ceramic and resin, or a magnetic material such as ferrite. A ground electrode 2 and a power supplying electrode 3 are formed on one end face 1*a* of the base member 1 with a gap g1 disposed therebetween. In the base member 1, a through hole 4 is formed between one end face 1*a* and the opposite end face 1*b*. A radiation electrode 5 is formed on the inside surface of the through hole 4. One end of the radiation electrode 5 is connected to the ground electrode 2, and the other end serves as an open end 5*a* on the end face 1*b*. In this embodiment, the power supplying electrode 3 and the radiation electrode 5 are electromagnetically coupled via a part of the ground terminal 2 through a capacitor formed by the gap g1.

In this embodiment, frequency adjustment is performed by cutting the ground electrode 2, the power supplying electrode 3, or the opening of the open end 5*a* of the radiation electrode 5. The level of coupling is adjusted by enlarging or reducing the gap g1.

Figure 2:
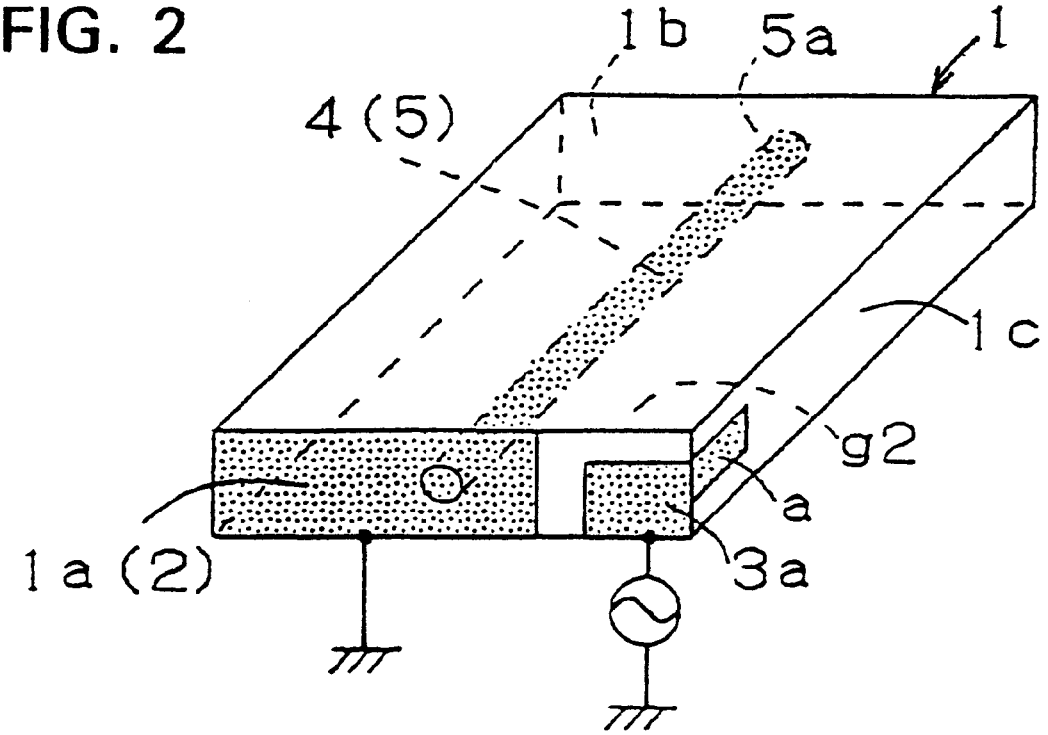
FIG. 2 is a perspective view of a surface-mount antenna according to a second embodiment of the present invention.

A second embodiment of the present invention will be described below by referring to FIG. 2. Since the second embodiment is the same as the first embodiment except for the shape and position of a power supplying electrode 3*a*, the same portions as those in the first embodiment are indicated by the same numbers and the descriptions thereof will be omitted.

The power supplying electrode 3*a* is formed such that it extends from an end face 1*a* to its adjacent end face 1*c*. A base-member gap g2 between the radiation electrode 5 and a portion "a" on the adjacent end face 1*c* of the power supplying electrode 3*a* forms a capacitor. In this embodiment, electromagnetic coupling between the power supplying electrode 3*a* ad the radiation electrode 5 is chiefly made by the capacitor formed at the base-member gap g2.

Figure 3:
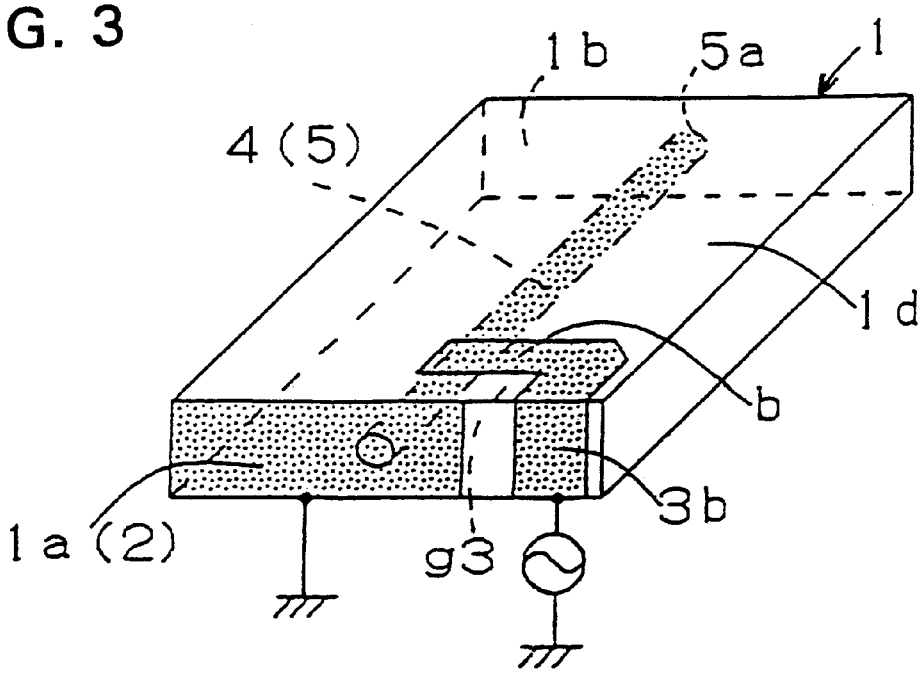
FIG. 3 is a perspective view of a surface-mount antenna according to a third embodiment of the present invention.

A third embodiment of the present invention will be described below by referring to FIG. 3. Since the third embodiment is the same as the first embodiment except for the shape and position of a power supplying electrode 3*b*, the same portions as those in the first embodiment are indicated by the same numbers and the descriptions thereof will be omitted.

The power supplying electrode 3*b* is formed such that it extends from an end face 1*a* to its adjacent main surface 1*d* and close to the vicinity of the radiation electrode 5. A base-member gap g3 between the radiation electrode 5 and a portion "b" on the adjacent main surface 1*d* of the power supplying electrode 3*b* forms a capacitor. In this embodiment, electromagnetic coupling between the power supplying electrode 3*b* and the radiation electrode 5 is chiefly made by the capacitor formed at the base-member gap g3.

Figure 4:
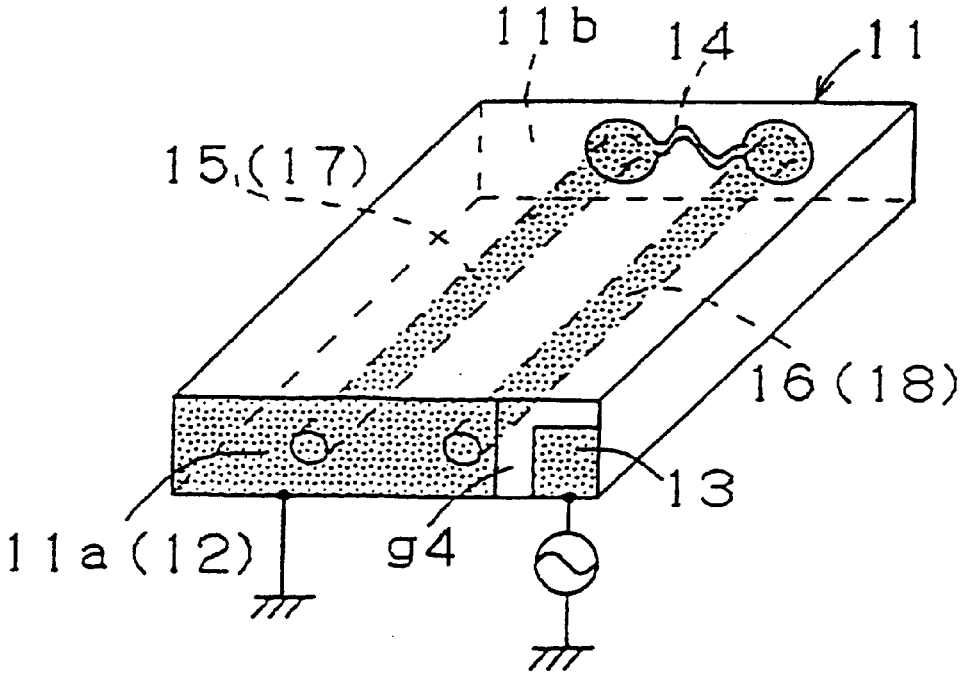
FIG. 4 is a perspective view of a surface-mount antenna according to a fourth embodiment of the present invention.

A fourth embodiment of the present invention will be described below by referring to FIG. 4. There is shown a rectangular-prism-shaped base member 11 made from a dielectric material such as ceramic and resin, or a magnetic material such as ferrite. A ground electrode 12 and a power supplying electrode 13 are formed on one end face 11*a* of the base member 11 with a gap g4 disposed therebetween. A pattern electrode 14 is formed on an end face 11*b* opposite the end face 11*a*. In the base member 11, two through holes 15 and 16 are formed between one end face 11*a* and the opposing end face 11*b*. Radiation electrodes 17 and 18 are formed on the inside surfaces of the through holes 15 and 16, respectively. One end of each of the radiation electrodes is connected to a ground electrode 12, and the other end is connected to both ends of the pattern electrode 14, respectively. In this embodiment, the power supplying electrode 13 and the radiation electrode 18 are electromagnetically coupled via a part of the ground terminal 12 through a capacitor formed at the gap g4.

Figure 5:
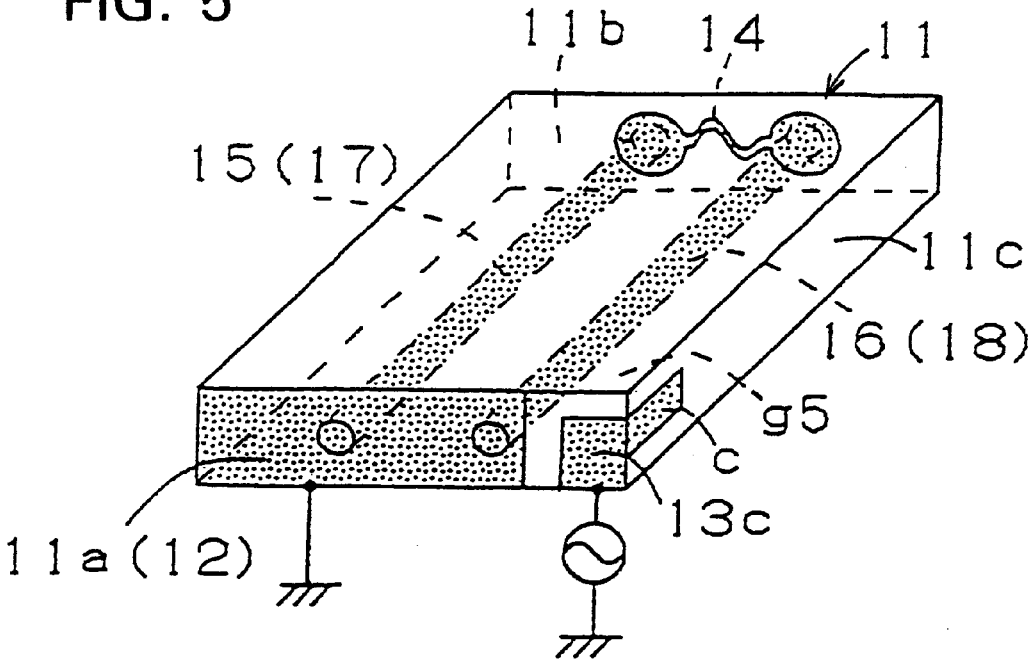
FIG. 5 is a perspective view of a surface-mount antenna according to a fifth embodiment of the present invention.

A fifth embodiment of the present invention will be described below by referring to FIG. 5. Since the fifth embodiment is the same as the fourth embodiment except for the shape and position of a power supplying electrode 13*c*, the same portions as those in the fourth embodiment are indicated by the same numbers and the descriptions thereof will be omitted.

The power supplying electrode 13*c* is formed such that it extends from an end face 11*a* to its adjacent end face 11*c*. A base-member gap g5 between a radiation electrode 18 and a portion "c" on the adjacent end face 11*c* of the power supplying electrode 3*a* forms a capacitor. In this embodiment, electromagnetic coupling between the power supplying electrode 13*c* and the radiation electrode 18 is chiefly made by the capacitor formed at the base-member gap g5.

Figure 6:
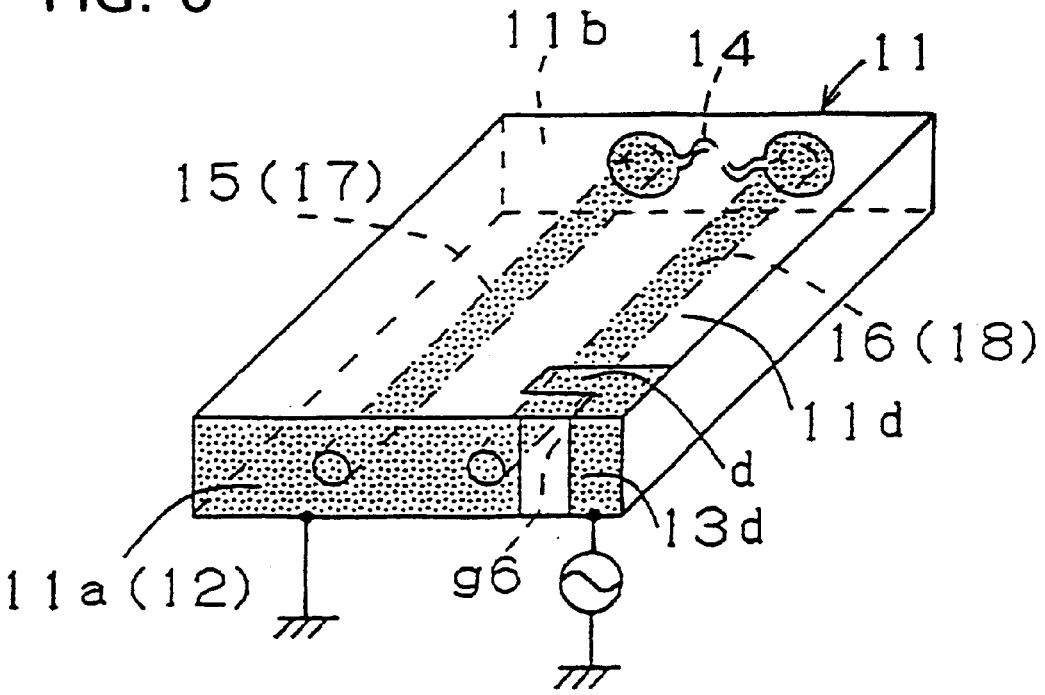
FIG. 6 is a perspective view of a surface-mount antenna according to a sixth embodiment of the present invention.

A sixth embodiment of the present invention will be described below by referring to FIG. 6. Since the sixth embodiment is the same as the fourth embodiment except for the shape and position of a power supplying electrode 13*d*, the same portions as those in the fourth embodiment are indicated by the same numbers and the descriptions thereof will be omitted.

The power supplying electrode 13*d* is formed such that it extends from an end face 11*a* to its adjacent main surface 11*d* and close to the vicinity of the radiation electrode 18. A base-member gap g6 between the radiation electrode 18 and a portion "d" on the adjacent main surface 11*d* of the power supplying electrode 13*d* forms a capacitor. In this embodiment, electromagnetic coupling between the power supplying electrode 13*d* and the radiation electrode 18 is chiefly made by the capacitor formed at the base-member gap g6.

Figure 7:
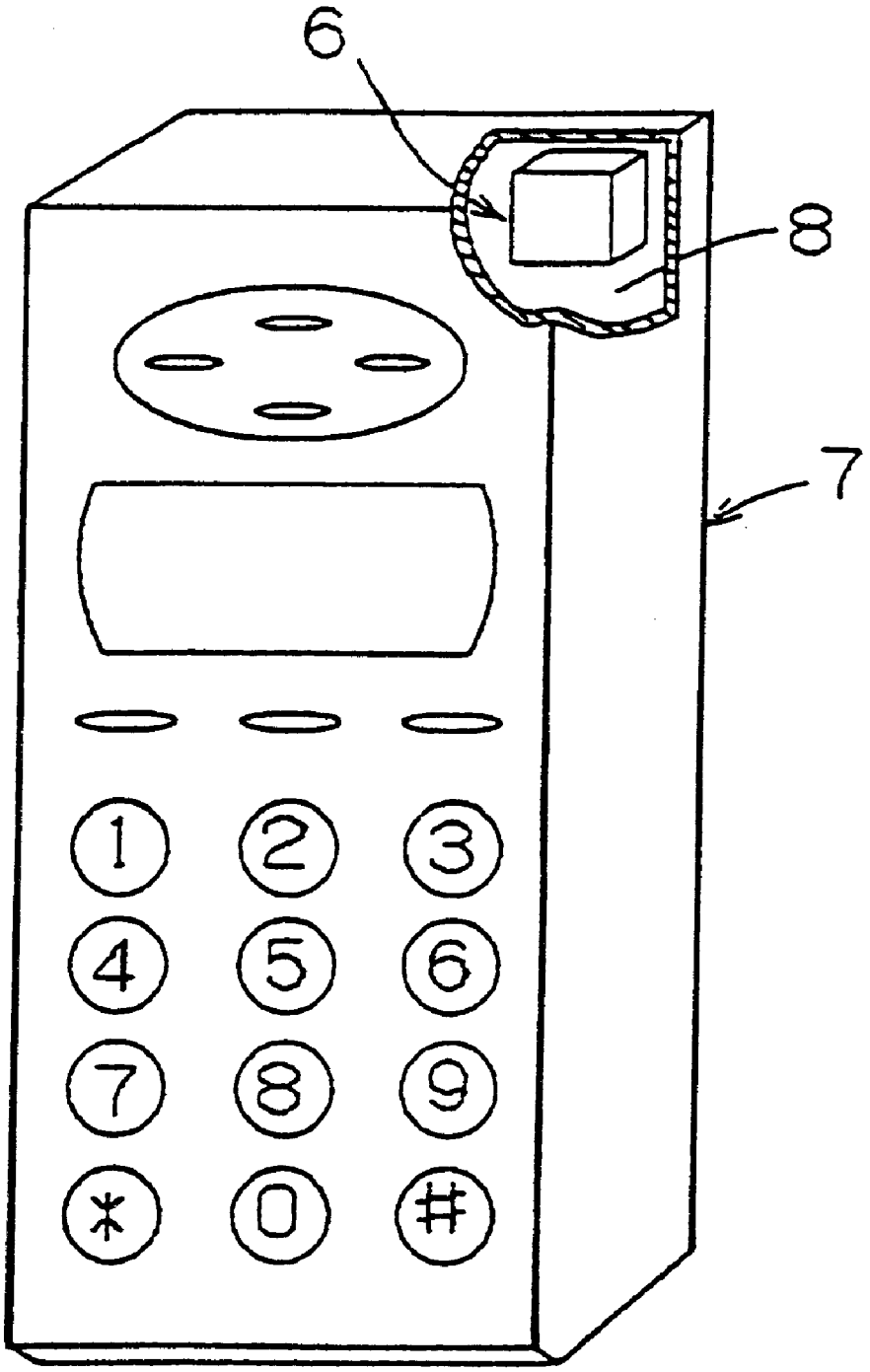
FIG. 7 is a perspective view of a communication apparatus on which a surface-mount antenna according to the present invention is mounted.
Figure 8:
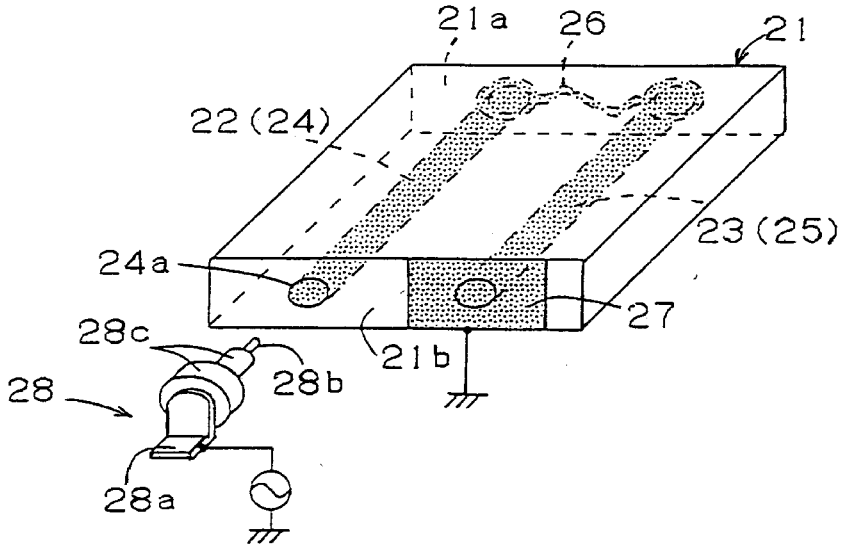
FIG. 8 PRIOR ART
FIG. 8 is a perspective view of a conventional surface-mount antenna.

FIG. 7 shows a communication apparatus in which one of the above-described surface-mount antennas is mounted. A surface-mount antenna 6 is mounted on a set printed circuit board (or its sub printed circuit board) 8 of a communication apparatus 7 comprising a transmitter/receiver by soldering its ground terminal and power supplying terminal.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A surface-mount antenna comprising:

a base member having two main surfaces and a plurality of end faces between the main surfaces;

at least one through hole formed between one of said end faces and an end face opposite to said one end face;

a ground electrode and a power supplying electrode formed on one end face of said base member;

a gap between said ground electrode and said power supplying electrode provided at said one end face of said base member and outside said through hole;

a radiation electrode formed on an inside surface of said through hole;

wherein one end of said radiation electrode is connected to said ground electrode and another end serves as an open end, said ground electrode surrounding said one end of said radiation electrode on said one end face and said open end being provided on said opposite end face; and said power supplying electrode and said radiation electrode being electromagnetically coupled through a capacitor formed at said gap.

2. The surface-mount antenna of claim 1, wherein the base member comprises at least one of a dielectric material and a magnetic material.

3. The surface-mount antenna of claim 1, wherein the base member comprises a rectangular parallelopiped.

4. A surface-mount antenna comprising:

a base member having two main surfaces and a plurality of end faces between the main surfaces;

a ground electrode and a first portion of a power supplying electrode formed on one end face of said base member;

a second portion of said power supplying electrode formed such that it extends onto an adjacent end face;

at least one through hole formed between said one end face and an opposite end face;

a gap between said ground electrode and said first portion of said power supplying electrode provided at said one end face of said base member and outside said through hole;

a radiation electrode formed on an inside surface of said through hole;

wherein one end of said radiation electrode is connected to said ground electrode and another end serves as an open end, said ground electrode surrounding said one end of said radiation electrode on said one end face and said open end being provided on said opposite end face; and said power supplying electrode and said radiation electrode being electromagnetically coupled through a capacitor formed by said gap and further by a base-member gap between said radiation electrode and the second portion of said power supplying electrode formed on said adjacent end face.

5. The surface-mount antenna of claim 4, wherein the base member comprises at least one of a dielectric material and a magnetic material.

6. The surface-mount antenna of claim 4, wherein the base member comprises a rectangular parallelopiped.

7. The surface-mount antenna of claim 4, wherein the power supplying electrode and radiation electrode are electromagnetically coupled mainly through the capacitor formed by the base-member gap.

8. A surface-mount antenna comprising:

base member having two main surfaces and a plurality of end faces between the main surfaces;

at least one through hole formed in said base member;

a radiation electrode formed on an inside surface of said through hole;

a ground electrode and a first portion of a power supplying electrode formed on one end face of said base member; and a second portion of said power supplying electrode formed such that it extends onto a main surface adjacent to said one end face and toward said radiation electrode;

a gap between said ground electrode and said first portion of said power supplying electrode provided at said one end face of said base member and outside said through hole;

wherein one end of said radiation electrode is connected to said ground electrode and another end serves as an open end, said ground electrode surrounding said one end of said radiation electrode on said one end face and said open end being provided on said opposite end face; and said power supplying electrode and said radiation electrode being electromagnetically coupled through a capacitor formed by said gap and further by a base-member gap between said radiation electrode and the second portion of said power supplying electrode formed on said main surface.

9. The surface-mount antenna of claim 8, wherein the base member comprises at least one of a dielectric material and a magnetic material.

10. The surface-mount antenna of claim 8, wherein the base member comprises a rectangular parallelopiped.

11. The surface-mount antenna of claim 8, wherein the power supplying electrode and radiation electrode are electromagnetically coupled mainly through the capacitor formed by the base-member gap.

12. A surface-mount antenna comprising:

a base member having two main surfaces and a plurality of end faces between the main surfaces;

a pattern electrode formed on one of said end faces;

a plurality of through holes formed between said one end face and an end face opposite said one end face;

a ground electrode and a power supplying electrode formed on one end face of said base member;

a gap between said ground electrode and said power supplying electrode provided at said one end face of said base member and outside said through hole;

radiation electrodes formed on inside surfaces of said plurality of through holes;

wherein one end of each of said radiation electrodes is connected to said ground electrode and another end of each of said radiation electrodes is connected to said pattern electrode; and said power supplying electrode and said radiation electrodes are electromagnetically coupled through a capacitor formed at said gap.

13. The surface-mount antenna of claim 12, wherein the base member comprises at least one of a dielectric material and a magnetic material.

14. The surface-mount antenna of claim 12, wherein the base member comprises a rectangular parallelopiped.

15. A surface-mount antenna comprising:

a base member having two main surfaces and a plurality of end faces between the main surfaces;

a ground electrode and a first portion of a power supplying electrode formed on one end face of said base member;

a second portion of said power supplying electrode formed such that it extends onto an end face adjacent to said one end face;

a pattern electrode formed on an end face opposite said one end face;

a plurality of through holes formed between said one end face and the opposite end face; and a gap between said ground electrode and said first portion of said power supplying electrode provided at said one end face of said base member and outside said through hole;

radiation electrodes formed on inside surfaces of said plurality of through holes;

wherein one end of each of said radiation electrodes is connected to said ground electrode and another end of each of said radiation electrodes is connected to said pattern electrode; and said power supplying electrode and said radiation electrode are electromagnetically coupled through a capacitor formed by said gap and further by a base-member gap between at least one of said radiation electrodes and the second portion of said power supplying electrode formed on said adjacent end face.

16. The surface-mount antenna of claim 15, wherein the base member comprises at least one of a dielectric material and a magnetic material.

17. The surface-mount antenna of claim 15, wherein the base member comprises a rectangular parallelopiped.

18. The surface-mount antenna of claim 15, wherein the power supplying electrode and radiation electrode are electromagnetically coupled mainly through the capacitor formed by the base-member gap.

19. A surface-mount antenna comprising:

a base member having two main surfaces and a plurality of end faces between the main surfaces;

a plurality of through holes formed in said base member;

radiation electrodes formed on inside surfaces of said plurality of through holes;

a ground electrode and a first portion of a power supplying electrode formed on one end face of said base member;

a second portion of said power supplying electrode formed such that it extends onto a main surface adjacent to said one end face and toward said radiation electrodes; and a gap between said ground electrode and said first portion of said power supplying electrode provided at said one end face of said base member and outside said through holes;

a pattern electrode formed on an end face opposite said one end face;

wherein one end of each of said radiation electrodes is connected to said ground electrode and another end of each of said radiation electrodes is connected to said pattern electrode; and said power supplying electrode and said radiation electrode are electromagnetically coupled through a capacitor formed by said gap and further by a base-member gap between at least one of said radiation electrodes and the second portion of said power supplying electrode formed on said main surface.

20. The surface-mount antenna of claim 19, wherein the base member comprises at least one of a dielectric material and a magnetic material.

21. The surface-mount antenna of claim 19, wherein the base member comprises a rectangular parallelopiped.

22. The surface-mount antenna of claim 19, wherein the power supplying electrode and radiation electrode are electromagnetically coupled mainly through the capacitor formed by the base-member gap.

23. A communication apparatus comprising:

at least one of an electromagnetic frequency receiver and transmitter;

a surface-mount antenna coupled to at least one of the receiver and transmitter, the surface-mount antenna comprising:

a base member having two main surfaces and a plurality of end faces between the main surfaces;

at least one through hole formed between one of said end faces and an end face opposite to said one end face;

a ground electrode and a power supplying electrode formed on one end face of said base member;

gap between said ground electrode and said power supplying electrode provided at said one end face of said base member and outside said through hole;

a radiation electrode formed on an inside surface of said through hole;

wherein one end of said radiation electrode is connected to said ground electrode and another end serves as an open end, said ground electrode surrounding said one end of said radiation electrode on said one end face and said open end being provided on said opposite end face; and said power supplying electrode and said radiation electrode being electromagnetically coupled through a capacitor formed at said gap.

24. A communication apparatus comprising:

at least one of an electromagnetic frequency receiver and transmitter;

a surface-mount antenna coupled to at least one of the receiver and transmitter, the surface-mount antenna comprising:

a base member having two main surfaces and a plurality of end faces between the main surfaces;

a ground electrode and a first portion of a power supplying electrode formed on one end face of said base member;

a second portion of said power supplying electrode formed such that it extends onto an adjacent end face;

at least one through hole formed between said one end face and an opposite end face;

a gap between said ground electrode and said first portion of said power supplying electrode provided at said one end face of said base member and outside said through hole;

a radiation electrode formed on an inside surface of said through hole;

wherein one end of said radiation electrode is connected to said ground electrode and another end serves as an open end, said ground electrode surrounding said one end of said radiation electrode on said one end face and said open end being provided on said opposite end face; and said power supplying electrode and said radiation electrode being electromagnetically coupled through a capacitor formed by said gap and further by a base-member gap between said radiation electrode and the second portion of said power supplying electrode formed on said adjacent end face.

25. The communication apparatus of claim 24, wherein the power supplying electrode and radiation electrode are electromagnetically coupled mainly through the capacitor formed by the base-member gap.

26. A communication apparatus comprising:

at least one of an electromagnetic frequency receiver and transmitter;

a surface-mount antenna coupled to at least one of the receiver and transmitter, the surface-mount antenna comprising:

a base member having two main surfaces and a plurality of end faces between the main surfaces;

at least one through hole formed in said base member;

a radiation electrode formed on an inside surface of said through hole;

a ground electrode and a first portion of a power supplying electrode formed on one end face of said base member;

a second portion of said power supplying electrode formed such that it extends onto a main surface adjacent to said one end face and close to a vicinity of said radiation electrode;

a gap between said ground electrode and said first portion of said power supplying electrode provided at said one end face of said base member and outside said through hole;

wherein one end of said radiation electrode is connected to said ground electrode and another end serves as an open end, said ground electrode surrounding said one end of said radiation electrode on said one end face and said open end being provided on said opposite end face; and said power supplying electrode and said radiation electrode being electromagnetically coupled through a capacitor formed by said gap and further by a base-member gap between said radiation electrode and the second portion of said power supplying electrode formed on said main surface.

27. The communication apparatus of claim 26, wherein the power supplying electrode and radiation electrode are electromagnetically coupled mainly through the capacitor formed by the base-member gap.

28. A communication apparatus comprising:

at least one of an electromagnetic frequency receiver and transmitter;

a surface-mount antenna coupled to at least one of the receiver and transmitter, the surface-mount antenna comprising:

a base member having two main surfaces and a plurality of end faces between the main surfaces;

a pattern electrode formed on one of said end faces;

a plurality of through holes formed between said one end face and an end face opposite said one end face; and a ground electrode and a power supplying electrode formed on one end face of said base member;

a gap between said ground electrode and said power supplying electrode provided at said one end face of said base member and outside said through holes radiation electrodes formed on inside surfaces of said plurality of through holes;

wherein one end of each of said radiation electrodes is connected to said ground electrode and another end of each of said radiation electrodes is connected to said pattern electrode; and said power supplying electrode and said radiation electrodes are electromagnetically coupled through a capacitor formed at said gap.

29. A communication apparatus comprising:

at least one of an electromagnetic frequency receiver and transmitter;

a surface-mount antenna coupled to at least one of the receiver and transmitter, the surface-mount antenna comprising:

a base member having two main surfaces and a plurality of end faces between the main surfaces;

a ground electrode and a first portion of a power supplying electrode formed on one end face of said base member;

a second portion of said power supplying electrode formed such that it extends to an end face adjacent to said one end face;

a pattern electrode formed on an end face opposite said one end face;

a plurality of through holes formed between said one end face and the opposite end face; and a gap between said ground electrode and said first portion of said power supplying electrode provided at said one end face of said base member and outside said through holes;

radiation electrodes formed on inside surfaces of said plurality of through holes;

wherein one end of each of said radiation electrodes is connected to said ground electrode and another end of each of said radiation electrodes is connected to said pattern electrode; and said power supplying electrode and said radiation electrode are electromagnetically coupled through a capacitor formed by said gap and further by a base-member gap between at least one of said radiation electrodes and the second portion of said power supplying electrode formed on said adjacent end face.

30. The communication apparatus of claim 29, wherein the power supplying electrode and radiation electrode are electromagnetically coupled mainly through the capacitor formed by the base-member gap.

31. A communication apparatus comprising:

at least one of an electromagnetic frequency receiver and transmitter;

a surface-mount antenna coupled to at least one of the receiver and transmitter, the surface-mount antenna comprising:

a base member having two main surfaces and a plurality of end faces between the main surfaces;

a plurality of through holes formed in said base member;

radiation electrodes formed on inside surfaces of said plurality of through holes;

a ground electrode and a first portion of a power supplying electrode formed on one end face of said base member;

a second portion of said power supplying electrode formed such that it extends to a main surface adjacent to said one end face and close to a vicinity of said radiation electrodes; and a gap between said around electrode and said first portion of said power supplying electrode provided at said one end face of said base member and outside said through holes;

a pattern electrode formed on an end face opposite said one end face;

wherein one end of each of said radiation electrodes is connected to said ground electrode and another end of each of said radiation electrodes is connected to said pattern electrode; and said power supplying electrode and said radiation electrode are electromagnetically coupled through a capacitor formed by said gap and further by a base-member gap between at least one of said radiation electrodes and the second portion of said power supplying electrode formed on said main surface.

32. The communication apparatus of claim 31, wherein the power supplying electrode and radiation electrode are electromagnetically coupled mainly through the capacitor formed by the base-member gap.

33. A surface-mount antenna comprising:

base member having at least one main surface and an end face abutting an edge of the main surface, the end face being dividable into a plurality of end face portions;

a ground electrode formed on one end face portion of said base member;

a power supplying electrode disposed on at least one of said main surface and end surface portions;

at least one through hole formed between said one end face portion and an opposite end face portion;

a radiation electrode formed on an inside surface of said through hole;

wherein one end of said radiation electrode is connected to said ground electrode and a second end comprises an open end, said ground electrode surrounding said one end of said radiation electrode on said one end face portion and said open end being provided on said opposite end face portion;

a gap disposed between the power supplying electrode and the ground electrode, the gap being disposed on said one end face portion of said base member and outside the through-hole; and said power supplying electrode and said radiation electrode are electromagnetically coupled through a capacitor formed at said gap.

34. The surface-mount antenna of claim 33, wherein the power supplying electrode further comprises a second portion disposed at least in part on the main surface extending toward the radiation electrode and further comprising a base-member gap between the radiation electrode and the power supplying electrode on the main surface.

35. The surface-mount antenna of claim 33, wherein the power supplying electrode further comprises a second portion disposed at least in part on an end face portion adjacent to said one end face portion, and further comprising a base-member gap between the radiation electrode and the power supplying electrode on said adjacent end face portion.

36. The surface-mount antenna of claim 33, further comprising:

a pattern electrode formed on an end face portion opposite the one end face portion;

a second through hole formed between the one end face portion and the opposite end face portion;

a second radiation electrode formed on an inside surface of said second through hole;

one end of the second radiation electrode also being connected to the ground electrode, the other ends of the first and second radiation electrodes being connected to the pattern electrode.

37. The surface-mount antenna of claim 36, wherein the power supplying electrode further comprises a second portion disposed at least in part on a main surface extending toward the radiation electrode and further comprising a base-member gap between the radiation electrode and the power supplying electrode on the main surface.

38. The surface-mount antenna of claim 36, wherein the power supplying electrode further comprises a second portion disposed at least in part on an end face portion adjacent to said one end face portion, and further comprising a base-member gap between the radiation electrode and the power supplying electrode on said adjacent end face portion.

39. The surface-mount antenna of claim 33, wherein the base member comprises at least one of a dielectric material and a magnetic material.

40. The surface-mount antenna of claim 33, wherein the base member has at least two main surfaces with the end face portions disposed between the main surfaces.

41. The surface-mount antenna of claim 40, wherein the base member comprises a rectangular parallelopiped.

* * * * *